United States Patent [19]

Bartleucci et al.

[11] Patent Number: 4,780,621

[45] Date of Patent: Oct. 25, 1988

[54] ORNAMENTAL LIGHTING SYSTEM

[75] Inventors: Frank J. Bartleucci, 20230 Hamlin St., Canoga Park, Calif. 91306; Karol Renau, Canoga Park, Calif.

[73] Assignees: Frank J. Bartleucci; Anthony Ciuffo, both of Canoga Park, Calif.

[21] Appl. No.: 68,353

[22] Filed: Jun. 30, 1987

[51] Int. Cl.[4] ..... H05B 37/00

[52] U.S. Cl. ..... 307/11; 307/38; 307/40; 340/825.69; 315/155; 315/192

[58] Field of Search ..... 307/34–41, 307/31, 11, 112, 113, 115, 117, 11 X, 132 R; 340/825.69, 825.72; 315/185 R, 185 S, 186, 191, 192, 193, 149, 153, 154, 155, 156, 158, 159; 362/152

[56] References Cited

U.S. PATENT DOCUMENTS

| | | | |
|---|---|---|---|
| 3,806,939 | 4/1974 | Palmieri | 340/825.69 X |
| 3,906,348 | 9/1975 | Willmott | 340/825.69 X |
| 4,016,474 | 4/1977 | Mason | 307/41 X |
| 4,072,898 | 2/1978 | Hellman et al. | 340/825.69 X |
| 4,177,388 | 12/1979 | Lingenfelter | 307/41 X |
| 4,215,277 | 7/1980 | Weiner et al. | 307/132 R X |
| 4,245,319 | 1/1981 | Hedges | 307/38 X |
| 4,262,213 | 4/1981 | Eichelberger et al. | 307/40 |
| 4,277,727 | 7/1981 | LeVert | 315/155 |
| 4,329,625 | 5/1982 | Nishizawa et al. | 315/192 X |
| 4,355,309 | 10/1982 | Hughey et al. | 340/825.69 X |

*Primary Examiner*—William M. Shoop, Jr.
*Assistant Examiner*—Paul Ip
*Attorney, Agent, or Firm*—Freilich, Hornbaker, Rosen & Fernandez

[57] ABSTRACT

A system for remotely controlling multiple light strings to achieve a wide variety of visual effects including, on the same string, variations in color, blink rate, and brightness.

15 Claims, 4 Drawing Sheets

ORNAMENTAL LIGHTING SYSTEM

FIELD OF THE INVENTION

This invention relates generally to ornamental lighting and more particularly to a lighting system especially suited for Christmas tree applications utilizing multiple light strings.

BACKGROUND OF THE INVENTION

The prior art is replete with systems for controlling lights for ornamental purposes, such as Christmas tree lighting. For example only, attention is called to the following U.S. Patents which are exemplary of systems for such applications; U.S. Pat. Nos.: 1,579,649; 2,453,925; 2,878,424; 3,614,528; 3,934,249; 4,215,277.

Of the aforecited patents, attention is particularly called to U.S. Pat. No. 4,215,277 which discloses a controller for sequentially energizing a plurality of light strings, e.g. Christmas tree light strings. The controller is characterized by the use of a plurality of solid state switches or triacs, each triac being connected in series between a 110 volt AC power supply and a light string comprised of multiple incandescent lamps connected in parallel. The triacs are controlled by a programmable ring counter which energizes the triacs in sequence. The counter, in turn, is switched by clock pulses supplied by an oscillator at a rate which can be varied by the user. When a triac is energized, it applies the 110 volt AC supply voltage to the light string connected thereto thus energizing all of the lamps on the string in an identical manner.

SUMMARY OF THE INVENTION

The present invention is directed to an improved system for remotely controlling multiple light strings to achieve a wide variety of visual effects including, on the same string, variations in color, blink rate, and brightness.

A system in accordance with the invention includes an oscillator for generating clock pulses at a rate determined by user switches which are preferably remotely controlled. The clock pulses drive a binary counter/divider having multiple binary stages, e.g. four. Each stage controls a different solid state switch, preferably a triac, so that, for example, stage A will switch at $\frac{1}{2}$ the clock rate, stage B at $\frac{1}{4}$ the clock rate, stage C at $\frac{1}{8}$ the clock rate, etc. Each triac can also be switched to, and held in, an "on" or "closed" state by a user switch. Each triac connects a different light string to a low voltage AC source so that while a triac is energized, the lamps of the light string connected thereto are energized solely by the source voltage.

In a preferred embodiment of the invention, each light string is comprised of light emitting diodes (LED's) connected in parallel.

In accordance with a specific feature of the preferred embodiment, first and second groups of monochrome LED's are connected with an opposite polarity orientation on the same light string. When the triac connected in series with that string is held on for one or more full cycles of the AC source voltage, both LED groups will be energized at full intensity. However, by limiting the triac on-state duration to less than a full cycle of the source voltage, the light emitted from the two LED groups on the same string will produce unique visual effects. For example, if the triac is on only during the positive half cycle of the source voltage, only the first LED group will emit light. On the other hand, if the triac is on only during the negative half cycle of the source voltage, only the second LED group will emit light. As the triac on-state shifts between these conditions, relative to the AC source voltage, the energization of the first and second LED groups will vary. This feature enables a single light string to exhibit multiple visual effects. For example, a single string will sometime energize its group one LED's (to, for example, blink red) and sometime energize its group two LED's (e.g. to, for example, blink green). Additionally, the strings can be energized so that both LED groups blink in unison or stay on together.

In accordance with a further feature of the preferred embodiment, tri-colored LED's are also incorporated on a light string, with or without one or two groups of monochrome LED's. The tri-colored LED's are energized to emit light of either a first, second, or third color, for example, red or yellow or green. Moreover, as the triac on-state shifts relative to the source voltage, the emitted light will gradually change color.

In accordance with a further feature of the preferred embodiment, the AC source voltage is delivered to the LED's at a very low level, e.g. 3.2 volts, thereby assuring the electrical safety of the system safe and making it well suited for use on Christmas trees.

In accordance with a still further aspect of the preferred embodiment, the aforementioned user switches are remotely controlled by a hand held transmitter which can be manually operated by a user.

DESCRIPTION OF PREFERRED EMBODIMENT

Figure 1:
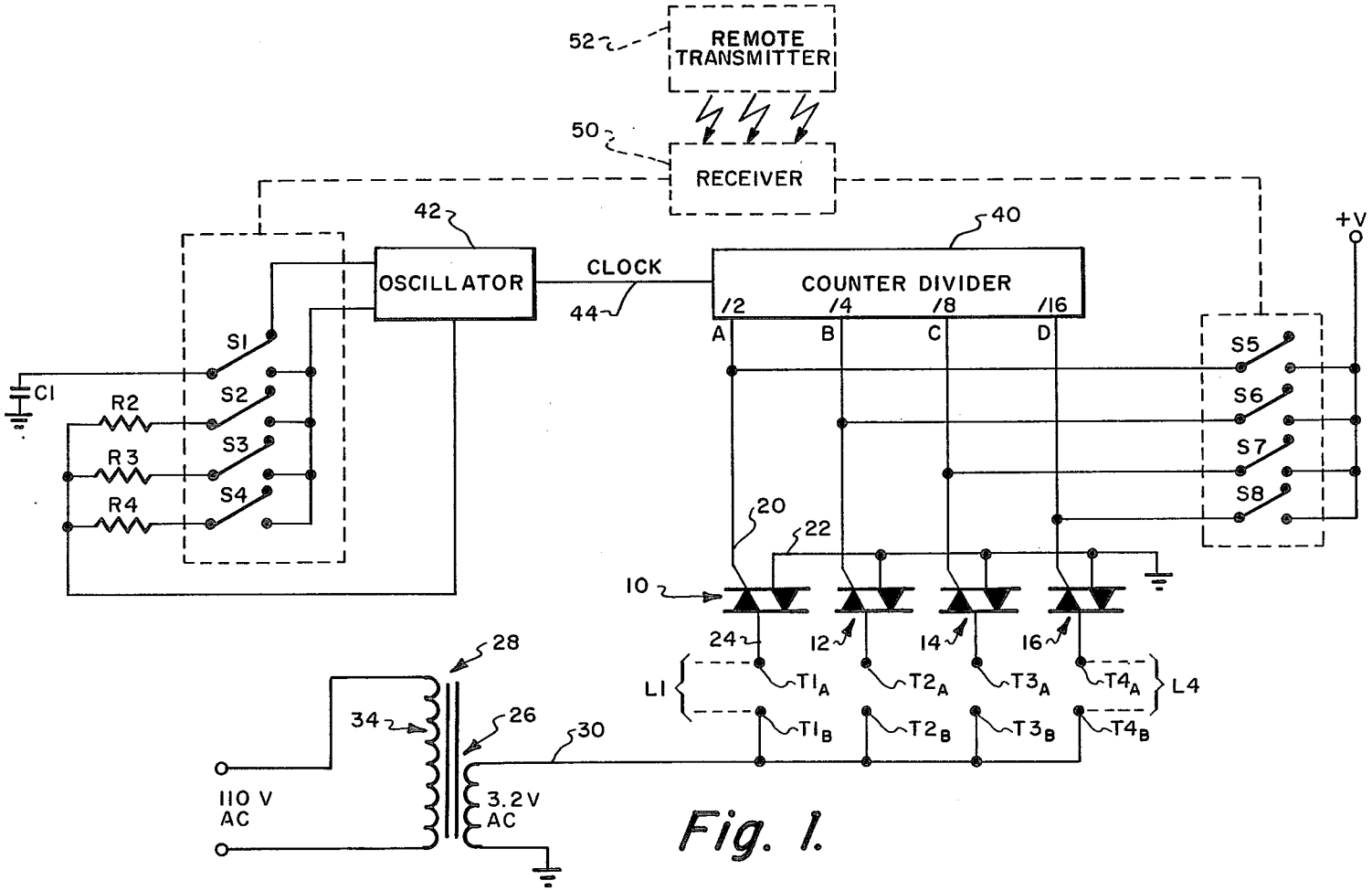
FIG. 1 is a block diagram of a lighting system in accordance with the present invention.

Attention is initially directed to FIG. 1 which illustrates a block diagram of a lighting system in accordance with the present invention. As will be seen hereinafter, the system of FIG. 1 can include multiple light strings which can be remotely controlled to achieve a wide variety of visual effects including, on the same string, variations in color, blink rate, and brightness. Systems in accordance with the invention will find application in many ornamental lighting situations but are particularly suited for lighting Christmas trees.

The system of FIG. 1 includes a plurality of gated solid state bidirectional switches, preferably triacs, 10, 12, 14, 16. Each triac is comprised of a gate terminal 20 and first and second main terminals 22, 24. As shown in FIG. 1, the triac main terminals 22 are connected in common and to ground. The main terminal 24 of each of the triacs is shown as being connected through an open terminal pair to the secondary winding 26 of a transformer 28. More specifically, main terminal 24 of triac 10 is connected through open terminal pair $T1_A$ and $T1_B$. Similarly, main terminal 24 of triac 12 is connected through terminals $T2_A/T2_B$, triac 14 through terminals $T3_A/T3_B$, and triac 16 through terminals $T4_A/T4_B$. Terminals $T1_B$, $T2_B$, $T3_B$ and $T4_B$ are connected in common to the floating end 30 of secondary coil 26. The other end 32 of coil 26 is connected to ground.

Figure 2:
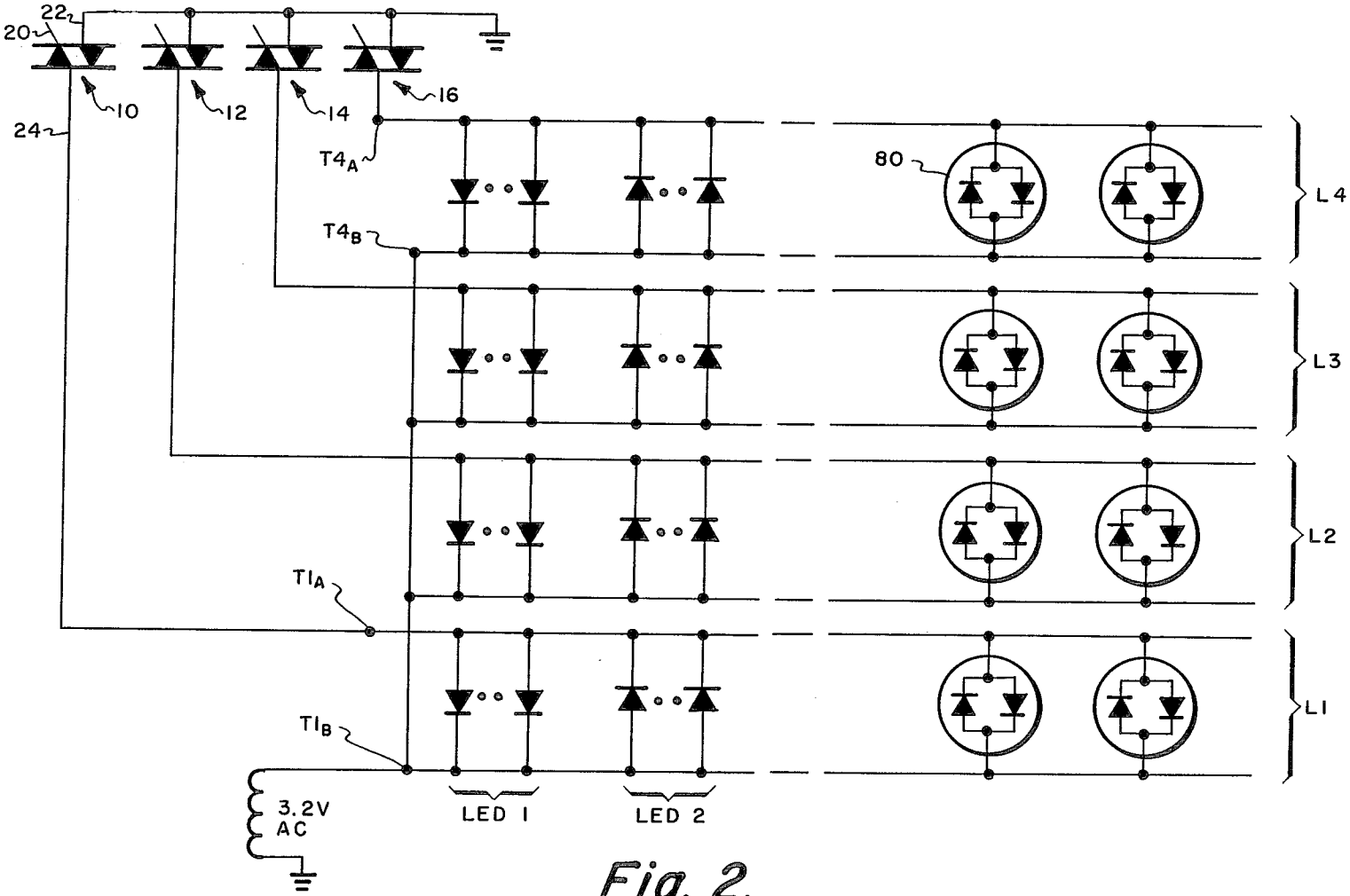
FIG. 2 is a schematic diagram primarily showing a light string in accordance with the present invention.

As will be discussed hereinafter in connection with FIG. 2, a different light string is connected between each open terminal pair depicted in FIG. 1, e.g. $T1_A/T1_B$. The details of the light strings will be discussed hereinafter but suffice it to understand at this stage that when a triac is gated into conduction, the alternating current source voltage produced by secondary coil 26 will be applied across the light string in series with the conducting triac. In accordance with the preferred embodiment of the invention, the secondary coil 26 produces a source voltage of low level, e.g. 3.2 volts, at frequency F1, e.g. 60 Hz. As shown, the primary coil 34 of the transformer 28 is connected across a standard 110 volt AC supply.

The gate terminals 20 of the triacs 10, 12, 14, 16 are respectively connected to different stage output terminals of a multiple stage binary counter divider 40. The counter divider 40 is driven by an oscillator 42 which provides clock pulses on line 44. The oscillator 42 outputs clock pulses at a frequency F2 defined by the effective resistance and capacitance (i.e. RC time constant) connected to the oscillator 42. FIG. 1 schematically depicts four user switches S1, S2, S3, and S4 which can be selectively controlled to vary the RC time constant of the oscillator 42. Each of the switches S1, S2, S3, S4 is switchable between first and second positions so that, for example, when switch S4 is switched to its lower position, resistor R4 is introduced into the effective resistance of the oscillator 42. It should be recognized, that with four switches provided, each operable in either a first or a second state, sixteen different RC time constants can be provided thereby enabling the oscillator 42 to output clock pulses at sixteen different discreet frequencies. In accordance with the preferred embodiment of the invention, these frequencies F2 can range between 20 Hz and 130 Hz.

The clock pulses output by the oscillator 42 on line 44 drive the multiple stage binary counter 40. In a preferred embodiment, it is assumed that the counter 40 is comprised of four stages enabling it to successively define the sixteen different states depicted by the following table:

| | A | B | C | D |
|---|---|---|---|---|
| 1 | LO | LO | LO | LO |
| 2 | LO | LO | LO | HI |
| 3 | LO | LO | HI | LO |
| 4 | LO | LO | HI | HI |
| 5 | LO | HI | LO | LO |
| 6 | LO | HI | LO | HI |
| 7 | LO | HI | HI | LO |
| 8 | LO | HI | HI | HI |
| 9 | HI | LO | LO | LO |
| 10 | HI | LO | LO | HI |
| 11 | HI | LO | HI | LO |
| 12 | HI | LO | HI | HI |
| 13 | HI | HI | LO | LO |
| 14 | HI | HI | LO | HI |
| 15 | HI | HI | HI | LO |
| 16 | HI | HI | HI | HI |

It will be noted from the foregoing table that the output of stage A switches at one half the frequency of the clock pulses whereas the output of stages B, C, and D respectively switch at $\frac{1}{4}$, $\frac{1}{8}$, and 1/16 the frequency of the applied clock pulses. The outputs of stages A, B, C, and D are respectively connected to the gate terminals 20 of triacs 10, 12, 14, and 16. It is assumed that the triac is gated into conduction when its gate terminal is high. When the triac is gated into conduction, it acts as a bidirectional switch enabling current to be conducted in either direction between the depicted open light string terminals dependent upon the polarity of the source voltage supplied by secondary coil 26.

The gate terminals 20, in addition to being controlled by the outputs of the counter divider 40, can also be controlled by separate switches S5, S6, S7, S8. When these switches are closed, they connect the triac gate terminals 22 to a positive voltage which acts to hold the triac in a conducting state.

The switches S1–S8 in FIG. 1 can comprise manually operated single pole switches. However, in accordance with a preferred embodiment of the invention, the switches are controlled by a receiver 50 in response to command signals transmitted by a remote hand held transmitter 52. The transmitter 52 and receiver 50 are devices which are known in the prior art and are capable of communicating via the transfer of infrared or radiofrequency energy. Regardless of the particular frequency spectrum utilized, it is contemplated that the remote transmitter 52 comprise a hand held device analogous to those transmitters widely used to control video cassette recorders. Utilizing the transmitter 52, a user can selectively generate switch commands to close any selected ones of the switches S1–S8. It will be recalled that switches S1–S4 control the frequency of the clock pulses output by oscillator 42. Each switch S5–S8, when closed, supplies an enabling gate signal to the triac connected thereto to maintain it in a conducting or on state.

It has been indicated that the system of FIG. 1, as thus far discussed, is utilized to control multiple light strings. Each such light string is connected between a pair of terminals, e.g. $T1_A$ and $T1_B$ as depicted in FIG. 1. Attention is now directed to FIG. 2 which illustrate light strings configured in accordance with the present invention. Note that light string L1, for example, is connected between terminals $T1_A$ and $T1_B$. Similarly, light string L4 is connected between terminals $T4_A$ and $T4_B$. In accordance with the invention each light string is comprised of multiple light emitting diodes connected in parallel. More specifically however, each light string includes first and second groups of light emitting diodes, respectively depicted as LED1 and LED2. The light emitting diodes of the first group LED1 are all connected in parallel with one another with a first polarity orientation; i.e. the anodes are shown as being connected to terminal $T1_A$ and the cathodes as being connected to terminal $T1_B$. On the other hand, the light emitting diodes LED2 of the second group are all connected in parallel but with a polarity orientation opposite to that of the first group LED1. That is, the anodes of group LED2 are connected to terminal $T1_B$ and the cathodes are connected to terminal $T1_A$. With two groups of light emitting diodes on a single light string being connected with opposite polarity orientations, a more varied and pleasing visual effect can be achieved because the two diode groups can appear to operate independently.

Figure 3:
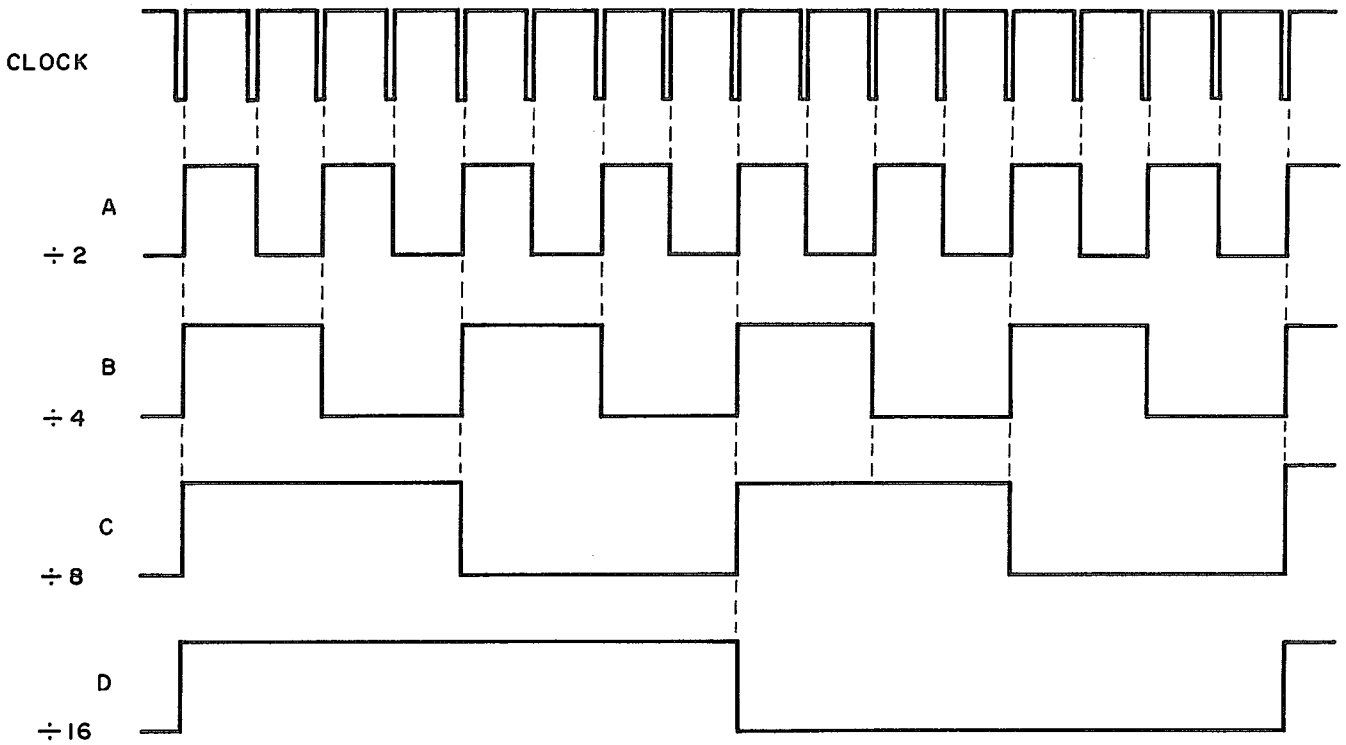
FIG. 3 is a waveform diagram depicting the operation of the binary counter/divider of FIG. 1.

In order to understand how the diodes of group LED1 and group LED2 can operate to produce different visual effects, consider in FIG. 3 that oscillator 42 is providing clock pulses at a rate of 120 Hz. This then means that the output terminals A, B, C, and D of counter/divider 40 will switch at 60 Hz, 30 Hz, 15 Hz, and 7½ Hz respectively.

Figure 4:
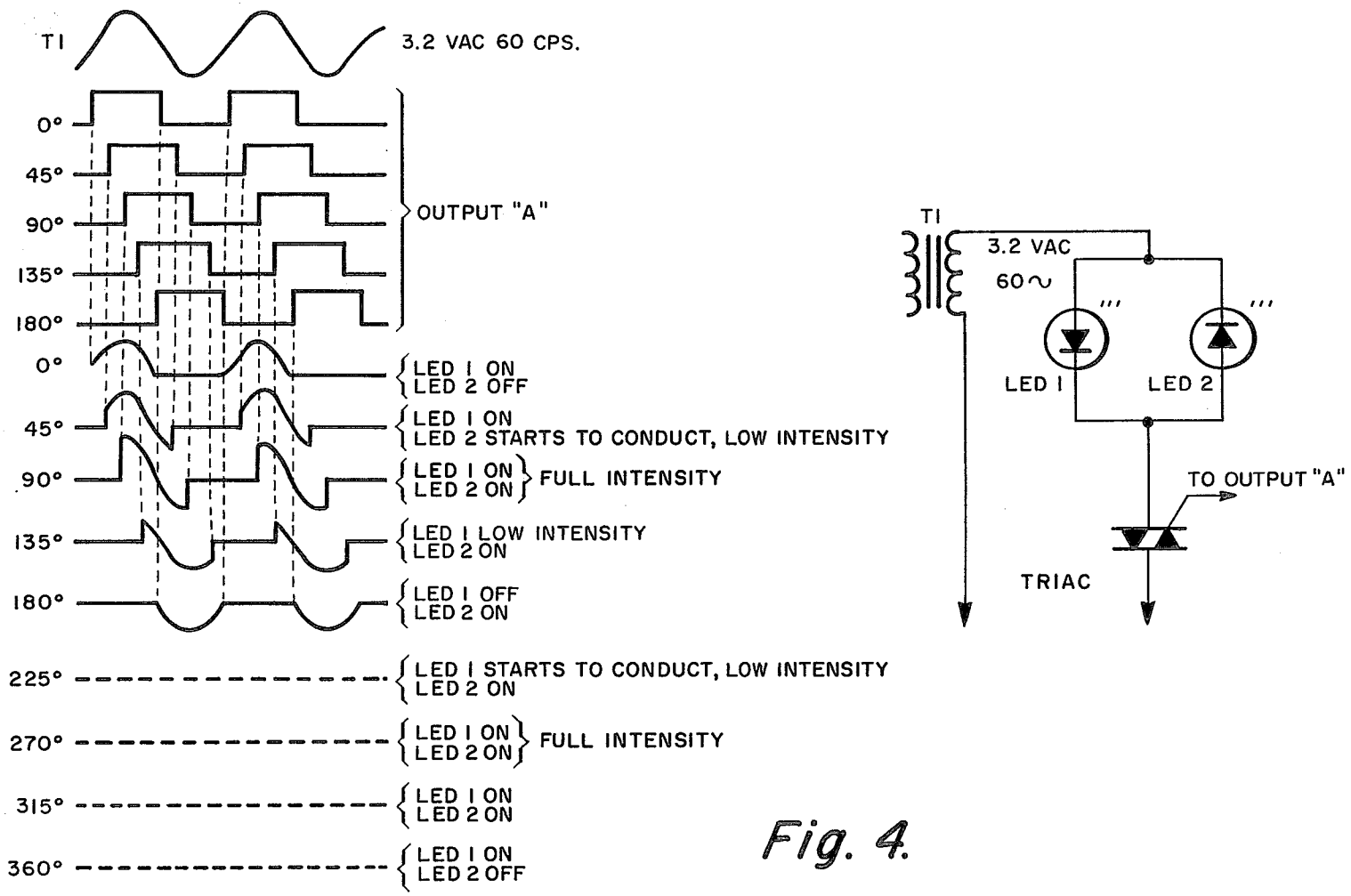
FIG. 4 is a waveform diagram depicting the operation of first and second groups of light emitting diodes when the switching frequency of the triac is approximately the same as the frequency of the AC source voltage.

FIG. 4 depicts output A of the counter divider 40 for different degrees of phase shift from 0° to 180° relative to the 60 Hz source voltage provided by transformer secondary coil 26. As previously mentioned, it has been assumed that the triac 10 conducts during the interval that output A is high. Note that when output A is in phase with the source voltage, the light emitting diodes of group LED1 will be on biased at a 60 Hz rate whereas the diodes of group LED2 will be off biased entirely.

Note that for a 45° phase shift between output A and the source voltage, the diodes of group LED1 will be on biased at a slightly lower intensity than for the aforementioned 0° phase shift and that the diodes of group LED2 will start to conduct at a 60 Hz rate but at a low intensity. For a 90° phase shift between output A and the source voltage, the diodes LED1 and LED2 will both conduct at a 60 Hz rate. For a 135° phase shift, the diodes of group LED1 will conduct at 60 Hz at a low intensity whereas the diodes of group LED2 will conduct at a higher intensity also at a 60 Hz rate. For a 180° phase shift, the diodes LED2 will be on biased at a 60 Hz rate whereas the diodes of LED1 will be off biased entirely.

Thus, the diodes of groups LED1 and LED2, although on the same string, will appear to operate independently as the output A of the counter divider 40 drifts in and out of phase with the source voltage frequency. In accordance with a preferred embodiment of the invention, the diodes of group LED1 comprise monochrome devices of one color whereas the diodes of group LED2 comprise monochrome devices of a different color. It should be recognized that if a light emitting diode is on-biased at a 60 Hz rate, it will appear to an observer to be constantly on. Blinking effects can be achieved by switching the triacs at a lower frequency rate, e.g. at rates depicted by outputs C and D of FIG. 3. For example, even with the clock pulses being provided at a 120 Hz rate as was previously assumed, outputs C and D of counter/divider 40 will switch the triacs connected thereto at 15 and 7.5 Hz respectively.

Thus, it should now be appreciated that the two groups of monochrome light emitting diodes, i.e. groups LED1 and LED2, can produce seemingly different visual effects. In lieu of, or together with, the groups of oppositely polled monochrome light emitting diodes, tricolored light emitting diodes 80 can be employed. The tricolored diodes 80 are commercially available devices and typically are comprised of oppositely polled monochrome light emitting diodes packaged within a common housing or envelope. When one of the diodes within the housing conducts, it emits a first color light, e.g. red, when the other diode conducts, it emits a second color, e.g. green, or when both diodes within the common housing conduct together, they create a third color light, e.g. yellow. It should be recognized that with a tricolored light emitting diode 80 being controlled by a triac operating as represented in FIG. 4 such that it drifts in and out of phase with the source voltage supplied by secondary winding 26, the tricolored LED will produce light which appears to gradually drift from a first color to a second color to a third color, etc.

From the foregoing, it should now be appreciated that a lighting system has been disclosed herein capable of achieving multiple visual effects particularly suited for lighting Christmas trees. By utilizing light strings having lamps comprising light emitting diodes, the lamps can be energized using a very low level source voltage, e.g. on the order of 3.2 volts, thereby making the lighting system extremely safe for home Christmas tree utilization. Further, by connecting light emitting diodes on a light string with an opposite polarity orientation, the two groups of light emitting diodes can appear to operate somewhat independently to produce unusual and pleasing effects. In accordance with a further significant aspect of a preferred embodiment, the frequency at which the clock pulses are provided to the counter divider to switch the light string can be varied by user switches preferably controlled by a user operated remote transmitter. Although, single pole-double throw switches have been illustrated, it should be recognized that other switch configurations can be employed; for example, in lieu of the bank of discrete switches S1–S4, a continuously variable switch could be used to more finely adjust the frequency of oscillator 42.

Although a preferred embodiment of the invention has been disclosed herein, it will be recognized that variations and modifications will occur to those skilled in the art and accordingly it is intended that the claims be interpreted to encompass such modifications and variations.

We claim:

1. An ornamental lighting system comprising:

a first light string having first and second terminals and a plurality of light emitting diodes including a first group connected in parallel between said first and second terminals and a second group connected in parallel with said first group but having an opposite polarity orientation;

switch means having first and second main terminals and operable either in an on-state to bidirectionally conduct between said first and second main terminals or an off-state to block conduction between said first and second main terminals;

source means for supplying a source voltage alternating at a frequency F1;

means connecting said source means in series with said light string first and second terminals and said switch means first and second main terminals;

means for generating successive clock pulses at a defined frequency F2; and means responsive to said clock pulses for periodically switching said switch means to said on-state to conduct current through said first group of light emitting diodes during a positive half cycle of said source voltage and through said second group of light emitting diodes during a negative half cycle of said source voltage whereby said first and second groups can be energized at different intensities.

2. The system of claim 1 including means for varying said clock pulse frequency.

3. The system of claim 2 wherein said means for varying said clock pulse frequency includes first and second switches;

remote transmitter means for transmitting switch command signals; and receiver means connected to said first and second switches and responsive to said command signals for controlling said switches.

4. The system of claim 3 wherein said remote transmitter means comprises a hand held unit manually operable by a user.

5. The system of claim 1 wherein said switch means is periodically in said on-state for a duration equal to or less than one full cycle of said source voltage.

6. The system of claim 1 wherein said first group of light emitting diodes includes monochrome devices for emitting a first color light and said second group of light emitting diodes includes monochrome devices for emitting a second color light.

7. The system of claim 1 wherein said plurality of light emitting diodes includes tricolored devices for selectively emitting light of a first or a second or a third color.

8. A system for energizing a plurality of physically distributed lamps to create various visual effects, said system comprising:

oscillator means for producing a train of clock pulses, said oscillator means including at least one oscillator switch means operable in a first state to produce said clock pulses at a frequency $F1_1$ and operable in a second state to produce said clock pulses at a frequency $F1_2$;

remote transmitter means for transmitting selected switch commands;

receiver means responsive to said switch commands for controlling said oscillator switch means;

source means for supplying a low level voltage alternating at a frequency $F_2$;

triac means having a gate terminal and first and second main terminals and operable in an on-state for bidirectionally conducting current between said main terminals and an off-state for blocking current conduction between said main terminals;

light string means having first and second terminals and including a plurality of lamps connected in parallel therebetween;

means connecting said source means and said triac means main terminals in series with said light string means first and second terminals;

control means responsive to said clock pulses for periodically supplying a gate signal to said triac means gate terminal to switch said triac means to said on-state;

said plurality of lamps including first and second groups of light emitting diodes;

said light emitting diodes of said first group being connected in parallel across said first and second terminals and having a common polarity orientation; and said light emitting diodes of said second group being connected in parallel across said first and second terminals and having a common polarity orientation opposite to that of said first group.

9. The system of claim 8 wherein said light emitting diodes of said first group emit light of a different color than said light emitting diodes of said second group.

10. The system of claim 8 wherein said light emitting diodes include devices for emitting light of a first or a second or a third color.

11. The system of claim 8 wherein said control means is operable to switch said triac means to said on-state for a duration equal to a selected number of clock pulses; and wherein said duration can be selected to be less than one cycle of said source means voltage.

12. The system of claim 8 wherein said control means comprises an N stage binary counter, each stage having an output terminal and defining either a logical true or false state; and wherein said binary counter counts said clock pulses to periodically switch each of said output terminals to said true logical state; and wherein said gate signal comprises the true logical state of one of said output terminals.

13. The system of claim 12 including multiple light string means and multiple triac means, each triac means connected in series with said source means and a different one of said light string means; and wherein each of said triac means has a gate terminal connected to a different one of said binary counter output terminals.

14. The system of claim 8 further including a triac switch means connected to said gate terminal and operable to switch said triac means to said on-state; and wherein said receiver means is responsive to said switch commands for controlling said triac switch means.

15. An ornamental lighting system comprising:

a first light string having first and second wires and a plurality of light emitting diodes including a first group connected in parallel between said first and second wires and a second group connected in parallel with said first group but having an opposite polarity orientation;

switch means having first and second main terminals and operable either in an on-state to bidirectionally conduct between said first and second main terminals or an off-state to block conduction between said first and second main terminals;

source means for supplying a source voltage alternating at a frequency F1;

means connecting said source means in series with said light string first and second wires and said switch means first and second main terminals; and means for periodically switching said switch means to said on-state for a duration substantially equal to or less than one full cycle of said source voltage to conduct current through said first group of light emitting diodes during a positive half cycle of said source voltage and through said second group of light emitting diodes during a negative half cycle of said source voltage whereby said first and second groups can produce different visual effects.

* * * * *